US010276142B2

(12) United States Patent
Ma

(10) Patent No.: US 10,276,142 B2
(45) Date of Patent: Apr. 30, 2019

(54) PICKUP SYSTEM AND ELECTRICALLY-AMPLIFIABLE STRINGED INSTRUMENT

(71) Applicant: Tobias Ma, Hamburg (DE)

(72) Inventor: Tobias Ma, Hamburg (DE)

( * ) Notice: Subject to any disclaimer, the term of this patent is extended or adjusted under 35 U.S.C. 154(b) by 0 days.

(21) Appl. No.: 15/742,822

(22) PCT Filed: Jun. 14, 2016

(86) PCT No.: PCT/EP2016/063614

§ 371 (c)(1),
(2) Date: Jan. 8, 2018

(87) PCT Pub. No.: WO2017/005461

PCT Pub. Date: Jan. 12, 2017

(65) Prior Publication Data

US 2018/0197518 A1 Jul. 12, 2018

(30) Foreign Application Priority Data

Jul. 6, 2015 (DE) ..... 10 2015 212 568

(51) Int. Cl.
*G10H 3/18* (2006.01)
*G10H 3/14* (2006.01)

(52) U.S. Cl.
CPC ..... *G10H 3/183* (2013.01); *G10H 3/143* (2013.01); *G10H 3/181* (2013.01)

(58) Field of Classification Search
CPC ..... G10H 3/183; G10H 3/143; G10H 3/181
USPC ..... 84/726
See application file for complete search history.

(56) References Cited

U.S. PATENT DOCUMENTS

| | | | |
|---|---|---|---|
| 3,911,777 | A | 10/1975 | Rendell |
| 5,831,196 | A | 11/1998 | Khanagov |
| 7,453,033 | B2 | 11/2008 | Redard |
| 7,718,886 | B1 | 5/2010 | Lace |
| 8,153,871 | B1 | 4/2012 | Fagrelius et al. |
| 9,514,726 | B2 * | 12/2016 | Palmieri, III ..... H01F 7/0205 |

(Continued)

FOREIGN PATENT DOCUMENTS

| | | |
|---|---|---|
| DE | 1 796 529 | 9/1959 |
| GB | 354301 | 8/1931 |

(Continued)

OTHER PUBLICATIONS

Examination Report from German Patent Office for Application No. 10 2015 212 568.8, dated Mar. 7, 2016, pp. 1-5.

(Continued)

*Primary Examiner* — Jeffrey Donels
(74) *Attorney, Agent, or Firm* — Saliwanchik, Lloyd & Eisenschenk

(57) ABSTRACT

The invention relates to a pickup system for an electrically-amplifiable stringed instrument, comprising a carrier element for a pickup magnet of an electromagnetic pickup, wherein said carrier element is L-shaped and can be connected to a bracket, the bracket supports a coil with a secondary winding of said electromagnetic pickup, and the L-shaped carrier element and the bracket form a primary winding of said electromagnetic pickup. The invention also relates to an electrically-amplifiable stringed instrument comprising such a pickup system.

12 Claims, 9 Drawing Sheets

(56) References Cited

U.S. PATENT DOCUMENTS

Figure 1:
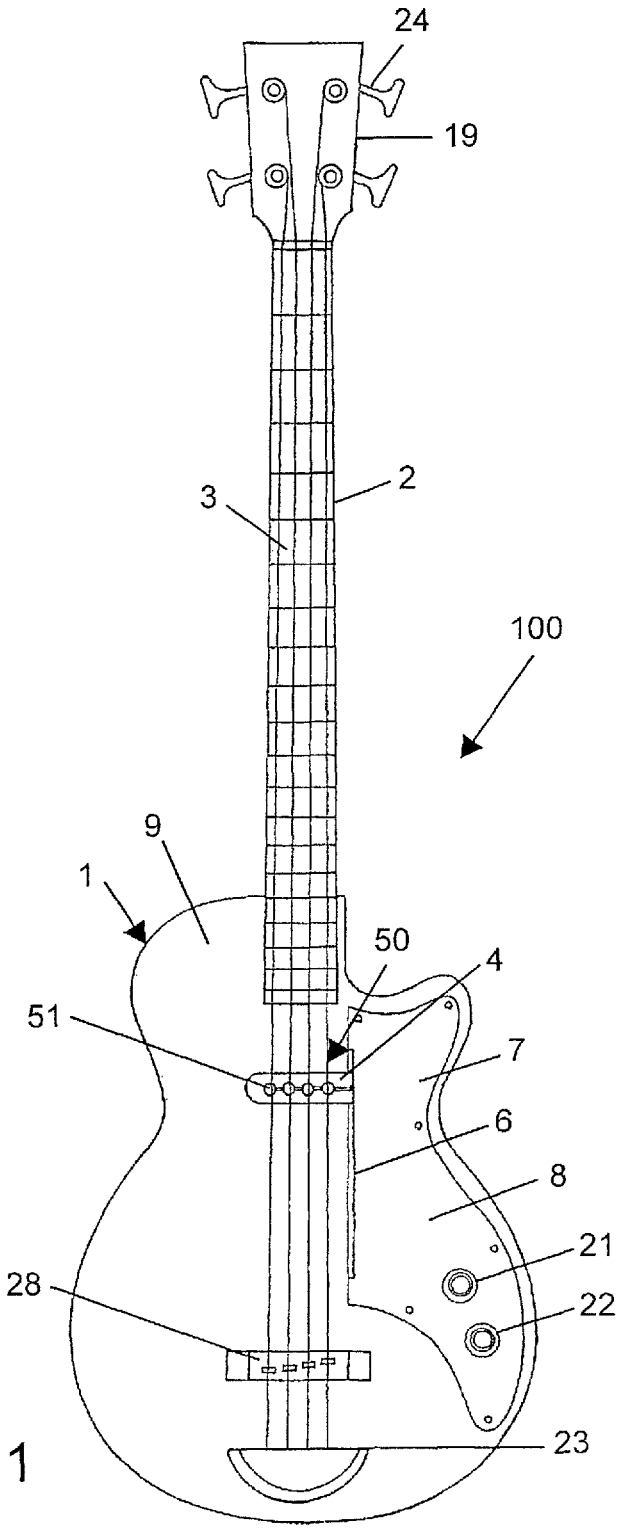

| | | | | |
|---|---|---|---|---|
| 2006/0054009 | A1* | 3/2006 | Redard | G10H 1/32 84/723 |
| 2015/0000508 | A1* | 1/2015 | Canavan | G10H 3/12 84/743 |
| 2016/0247497 | A1* | 8/2016 | Palmieri, III | H01F 7/0205 |

FOREIGN PATENT DOCUMENTS

| | | |
|---|---|---|
| GB | 2 173 032 | 10/1986 |
| GB | 2 406 956 | 4/2005 |
| WO | WO 2009/091360 | 7/2009 |

OTHER PUBLICATIONS

International Search Report for Application No. PCT/EP2016/063614, dated Sep. 14, 2016, pp. 1-6.

* cited by examiner

PICKUP SYSTEM AND ELECTRICALLY-AMPLIFIABLE STRINGED INSTRUMENT

CROSS-REFERENCE TO RELATED APPLICATIONS

The present application is the U.S. National Stage Application of International Patent Application No. PCT/EP2016/063614, filed on Jun. 14, 2016, which claims priority to German Patent Application No. 10 2015 212 568.8, filed on Jul. 6, 2015, both of which are hereby incorporated by reference herein in their entirety, including any figures, tables, or drawings.

The present invention relates to a pickup system for an electrically-amplifiable stringed instrument with a carrier element for a pickup magnet and an electrically-amplifiable stringed instrument with such a pickup system.

At the body of commercially available electrically stringed instruments, for example electric guitars or electric bass guitars, usually one or more cutouts are formed, in which the pickups of the stringed instrument are arranged. The pickups are in general spring-mounted within the cutouts and fixated with screws, whereby via the screws to a limited extent a pitch adjustment of the pickups is possible. Thereby the volume of the individual strings and their sound can be varied to a limited extent. The spring mount is in this case achieved by using pressure springs, foam or silicone hoses, which are appropriately pre-tensioned via the screws.

The cutout for a pickup can also be dispensed with, if the strings run high enough over the body cover. This is achieved, if the neck of the E-guitar or the E-bass guitar is connected with the body relatively high above the body, comprises a suitably high bridge construction, and flatly constructed pickups are chosen. Thereby the pickups are usually wider to realize a large enough winding number of windings at the pickup.

All these constructions, however, have in common that a once chosen position of the pickup cannot be changed anymore, since the pickup is fixedly connected with the body.

Since the strings oscillate differently from the end of the neck towards the bridge, different sounds can be achieved by an appropriate positioning of the pickup. Depending on the desired sound variety, at these electrically-amplifiable stringed instruments one or more pickups are arranged between the end of the neck and the bridge.

Furthermore stringed instruments with movable pickups are known from the prior art. GB 2 173 032 A discloses a movable pickup, which is guided along two guiding rails, which are arranged at the right and the left of the strings.

A pickup system is known from the GB 2 406 956 A, in which each of the pickups for each string of the stringed instrument is separately movable. Such a solution is, however, very involved and very expensive.

An E-guitar with a movable pickup is known from the U.S. Pat. No. 3,911,777 A, wherein a cutout is provided in the region of the pickup at the body, which has the width of the pickup, so that the pickup can be moved in this cutout.

A stringed instrument is known from the U.S. Pat. No. 7,453,033 B2, in which a pickup is arranged on a guiding rail and is positioned above the strings, therefore not between the strings and the body.

However, a disadvantage of the known movable pickups is that they impair the optics of the instrument partially very strongly and thus have led to little acceptance of the musicians.

The objective of the invention is to provide a pickup system with a pickup for an electrically-amplifiable stringed instrument, which allows a large variety of sound variations and impairs the optics of the instrument only slightly.

The objective is solved with a pickup system, which comprises an L-shaped carrier element for a pickup magnet, which is connectable with a bracket, wherein the bracket supports a coil with a secondary winding of the electromagnetic pickup, and wherein the L-shaped carrier element and the bracket form a primary winding of the electromagnetic pickup. Thereby a modular structure can be achieved, by which the coil respectively the secondary winding of the pickup can be exchanged easily and therefore the sound of the stringed instrument can easily be adjusted by an altered pickup. Furthermore a particularly slim assembly group, which can easily be positioned between the body and the strings of the stringed instrument, is formed by the L-shaped carrier element and the therewith connected pickup magnet. The L-shaped carrier element, which is made of a conductive material, for example aluminum or copper, and the bracket form a primary winding and the coil a secondary winding, via which the signal of the pickup magnet is amplified. By the positioning of the coil at the bracket so much space is obtained that quasi arbitrary shapes and sizes of pickups can be chosen. The pickup system is structured modularly, so that the bracket can easily be unfastened from the L-shaped carrier element, in particular via a screwed joint. Therefore the bracket can be detached easily and the coil of the pickup, which is arranged at the bracket, can easily be exchanged. Therefore a simple exchange of a pickup and a corresponding adjustment of the sound of the electronically-amplified stringed instrument are possible.

Through the provisions which are specified in the dependent claims advantageous embodiments and improvements of the pickup system of the independent claim are possible.

According to an advantageous embodiment it is provided that the L-shaped carrier element, the bracket and/or the glide body are, at least partially, provided with a coating, which reduces the contact resistance in the region of the contact areas. For example the L-shaped carrier element and the bracket can be gold-plated in the contact region.

According to an advantageous embodiment it is provided that the pickup system comprises a glide body, wherein a retainer for the L-shaped carrier element is provided on the glide body, and wherein the glide body is movable. By a connection of the L-shaped carrier element and the glide body only a small slit in the body of the stringed instrument is necessary, which moreover can run outside the neck or an extension of the neck through the body, so that the region where the strings run is not influenced optically and acoustically. Moreover, an L-shape of the carrier element allows that the carrier element can be moved during playing with one hand, namely the hand which is used to hit the strings. With the simple, modular structure, a pickup system according to the invention can also be retrofitted to a stringed instrument with a conventional pickup. With an L-shaped carrier element it is possible to guide the carrier element through a slit on the upper side of the body. Thereby, different shapes and sizes of the carrier element are possible, which lead to a plurality of design possibilities. Thereby, the glide body can remain unchanged, by which is achieved a modular construction.

According to a further advantageous embodiment of the pickup system it is provided that the glide body comprises a transmission element, via which a signal of at least one pickup is transmittable. The transmission element can be screwed on the glide body and can include a connection for an external cable, in particular a phone jack. Moreover, the glide body can comprise sliding contacts, via which a signal of the pickup can be transmitted to a conductive path. This is particularly advantageous with a movable pickup, since thereby an easy movability between the glide body and the conductive path can be realized.

According to an advantageous embodiment it is provided that at least one amplification element for amplifying the signal recorded by the at least one pickup is arranged at the glide body. Thereby, a signal amplification can take place near the region, where the signal is produced, so that conduction loss at the transmission does not lead to a strong reduction or loss of the signal.

According to an advantageous embodiment it is provided that the pickup system comprises two movable L-shaped carrier elements, each of which carries at least one electromagnetic pickup and each is retained in a separate glide body, wherein the glide bodies are independently movable. With two movable pickups sounds can be achieved, for which in conventional pickup systems three or more permanently installed pickups are necessary, which can be connected with each other in parallel or serial. By two movable carrier elements, however, additional combinations of position and sound are added.

According to a further advantageous embodiment it is provided that the signal of the pickup is transmitted via the glide body to a conductive path, or that the signals of the pickups are transmitted via the glide bodies to a common conductive path. Conductive paths and thereon movable sliding contacts, preferably brushes, are a simple and technically easily realizable possibility to transmit the signal of the pickup with a movable carrier element. It is thereby particularly advantageous, if two separate conductive paths each are provided for the two glide bodies, so that the signals of the pickups can be transmitted independently of each other. Via the signal transmission along the conductive paths a simple signal transduction at the conductive paths is possible, which can always take place at the same position, so that no additional cables are necessary. Therefore the risk of a detaching or tearing cable through the movement of the carrier elements can be seas prevented. Alternatively, common conductive paths can be provided for both glide elements, wherein this leads to a necessary coupling of the signals of the pickups.

According to an advantageous embodiment it is provided that at least one of the carrier elements comprises a recess. Pickups are often equipped with caps, which can for example carry a logo of a band or a writing. By a recess in the carrier element, such a cap can easily and safely be mounted at the carrier element respectively at a pickup. This can in particular be achieved by introducing the cap sideways into the recess, so that no removal of the strings is necessary. Therefore a simple and fast mounting of such a cap is possible. Moreover, with that different caps can be exchanged easily and fast. Additionally, a latching mechanism can be provided at the carrier element, in particular at the recess and/or the cap, by which the cap immovably latches at least at an end position.

According to a further advantageous embodiment it is provided that the primary winding of the pickup comprises the bracket and the L-shaped carrier element, wherein the bracket is detachably connectable with the L-shaped carrier element. Thus, a particularly flat pickup can be constructed, which comprises at least one magnet and can dispense with a larger coil body in the region of the strings. Also by forming the primary winding with the L-shaped carrier element and the bracket it is easily possible to exchange the amplification element in order to achieve different sound results. For this the cores of the coils, the number of windings, the wire gauge and further parameters can be changed.

According to an advantageous embodiment it is provided that the L-shaped carrier element for the pickup is guided through a slit in the glide body and is detachably mounted at the glide body. By a detachable mounting, in particular by a screw joint, a simple exchange of the L-shaped carrier element is possible. No additional soldiering or similar is necessary. Moreover, the detachable mounting simplifies a disassembly of the components, whereby a flexible and modular construction of the pickup system is promoted.

An electrically-amplifiable stringed instrument according to the invention with a pickup system according to the invention is distinguished by the L-shaped carrier element guided through a slit-shaped opening in the body of the stringed instrument, in which the L-shaped carrier element is movably arranged. Therefore the optics of the front surface of the stringed instrument is impaired only slightly, and, for example, no heightening of the neck with respect to a surface on the front surface of the body is necessary. Additionally the L-shaped carrier element can particularly easily be moved with one finger tap. Thus the musician oneself can move the arrangement during the play with the hand that is hitting the strings. For example, when using a plectrum the carrier element can be moved with the middle finger or ring finger of the hand. With that the cutouts for retaining the glide body as well as the further electric components of the guitar can be positioned at the rear surface, so that a pickguard can be dispensed with. Thus, common amplification elements and control units, for example for regulating the sound or the volume, can be used without further modifications.

With that it is particularly advantageous, if the slit-shaped opening in the body runs sidelong the neck or sidelong an extension of the neck through the body. Thereby a simple positioning of the opening in the body is possible. Additionally, the moving of the carrier element is simplified by that, since the strings in this position do not impair the accessibility to the moving axis of the carrier element. By the L-shaped forming of the carrier element and the slit-shaped opening running sidelong the neck or the extension of the neck, thus sidelong parallel to the strings, the risk of tilting the carrier element is reduced, so that when moving the carrier element no jamming and corresponding rough-running occur. Therefore, the carrier element can always be moved easily and safely.

According to an embodiment it is provided that the body is segmented in several parts, wherein the body comprises a base body and a cover, and wherein the slit-shaped opening is formed between the base body and the cover. By the segmentation in several parts of the body, the slit-shaped opening can particularly simple be placed in the body or result from a gap between two or more parts. Since often in this region, a color gradient between two colors is located, the base body and the cover are thus realized in different colors, the slit-shaped opening attracts only little attention, so that the optical impairment of the front surface can be kept small. With that, particularly advantageous is if the cover is a pickguard. A pickguard can cover cutouts at the front surface of the body, which are provided for example for components for the electrical amplification or for sound and/or volume control. A pickguard is typically realized with a material, which is less sensitive to scratches than the material of the body, so that when playing the stringed instrument no optical impairment results. By a slit-shaped opening that is positioned in the pickguard, the pickup system according to the invention can also be retrofitted in already existing stringed instruments.

Figure 2:
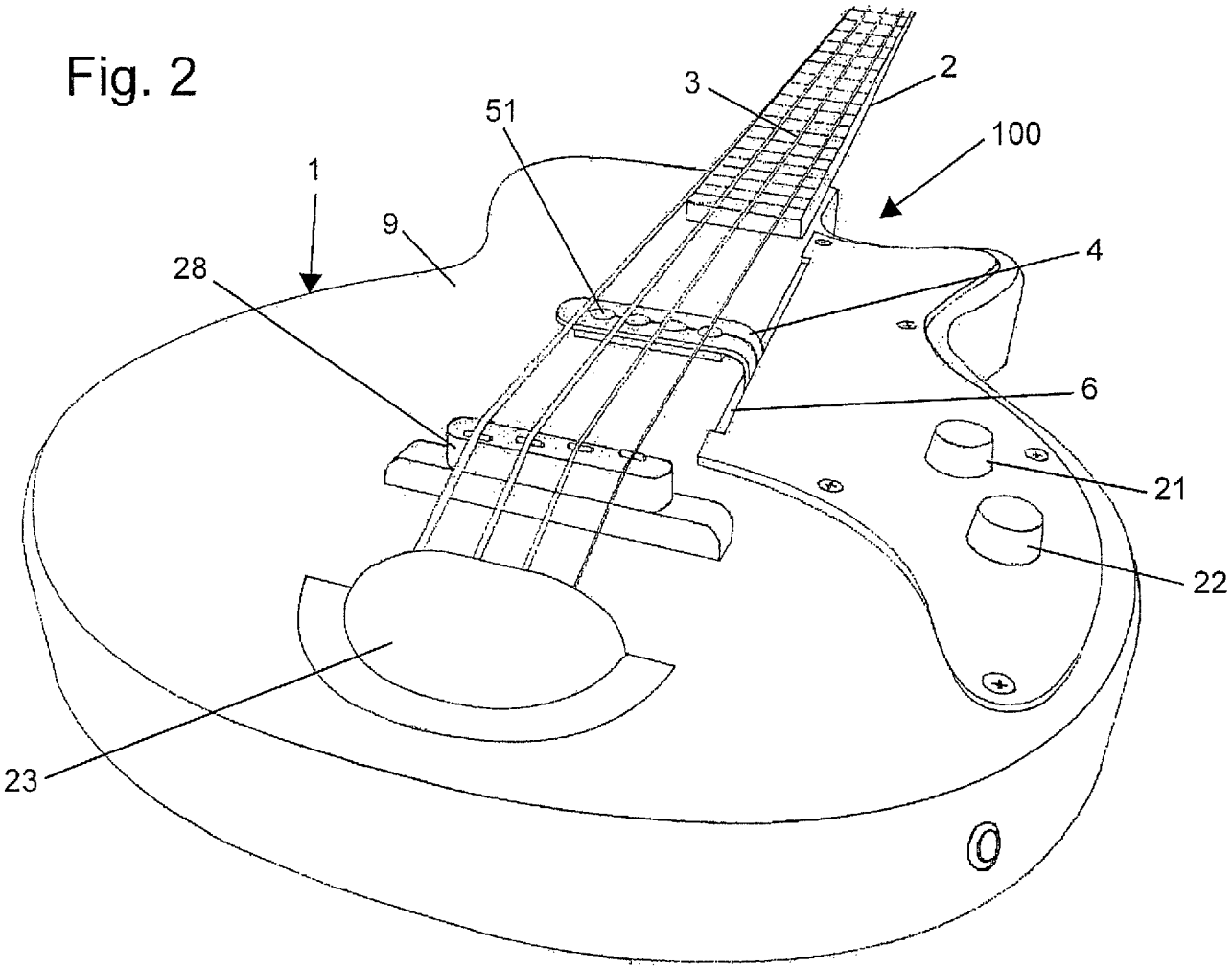
Figure 3:
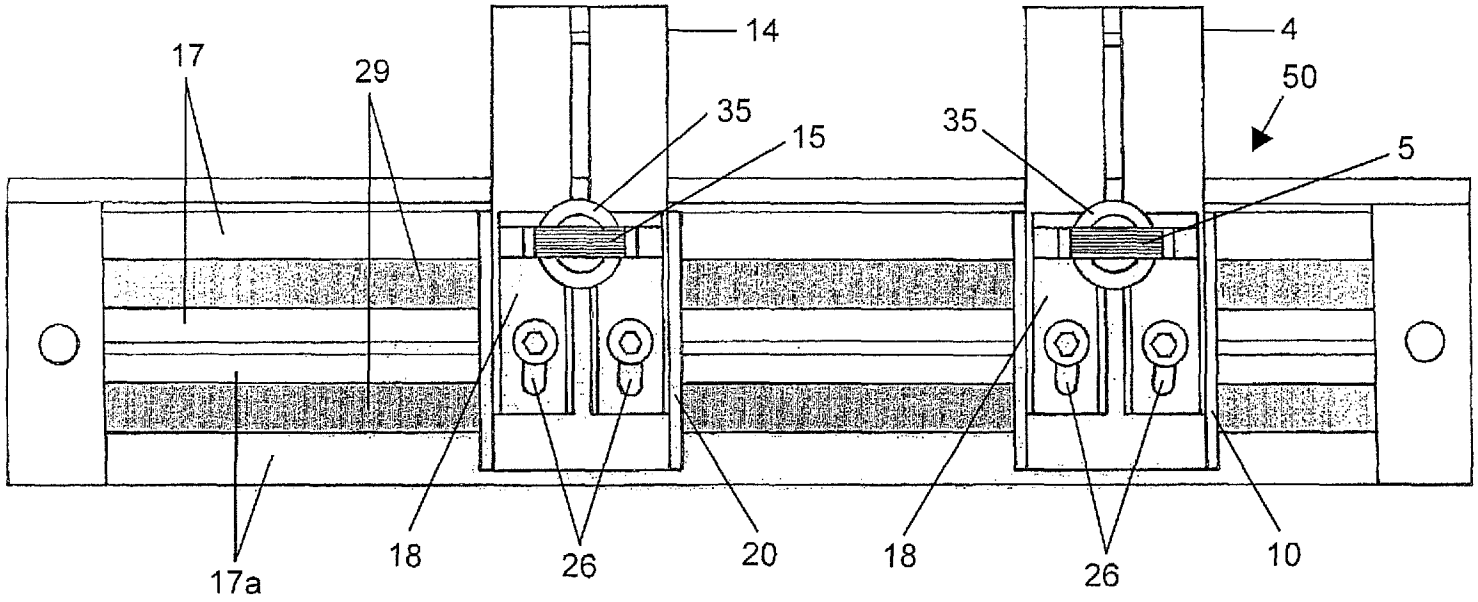
Figure 4:
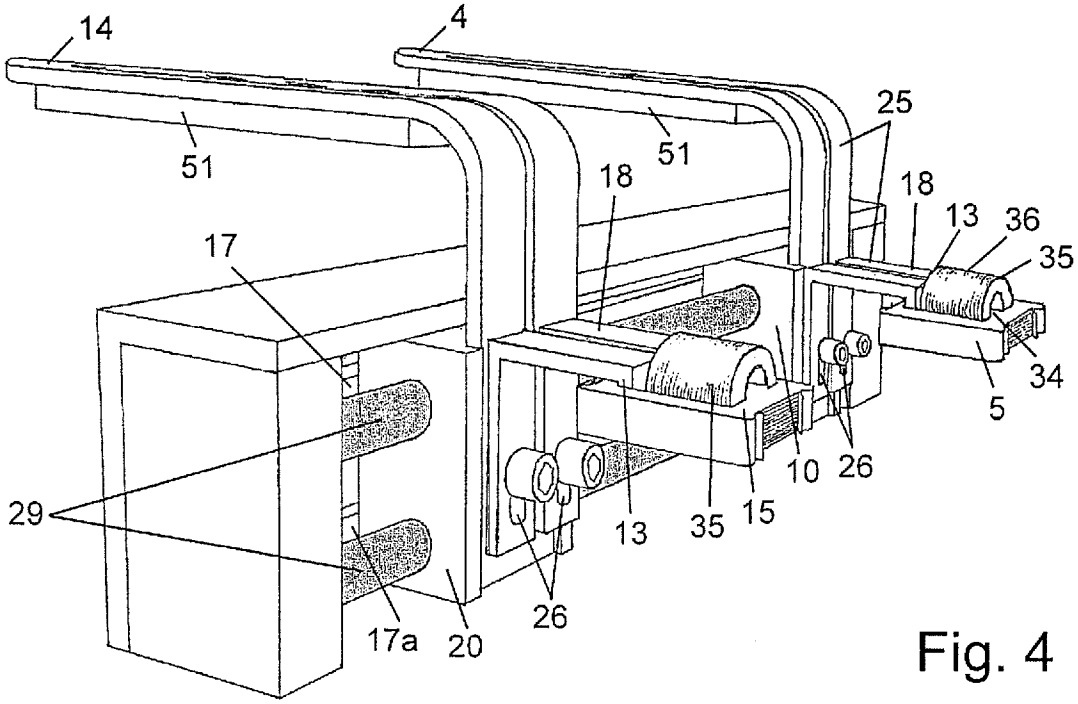
Figure 5:
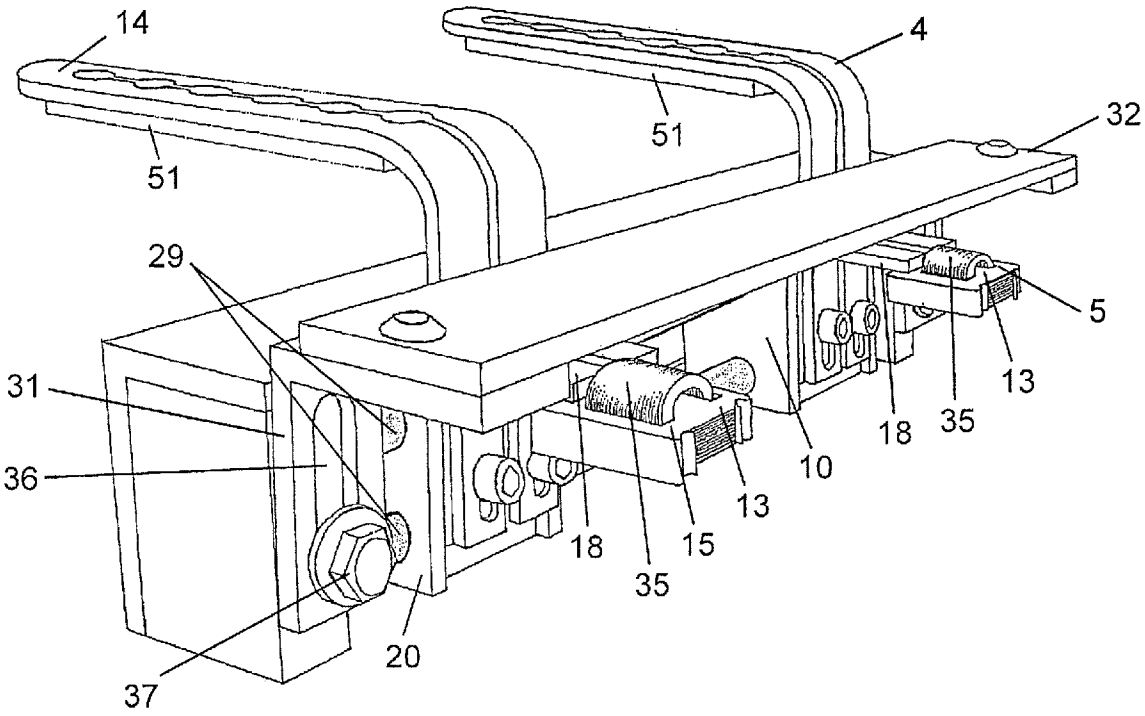
Figure 6:
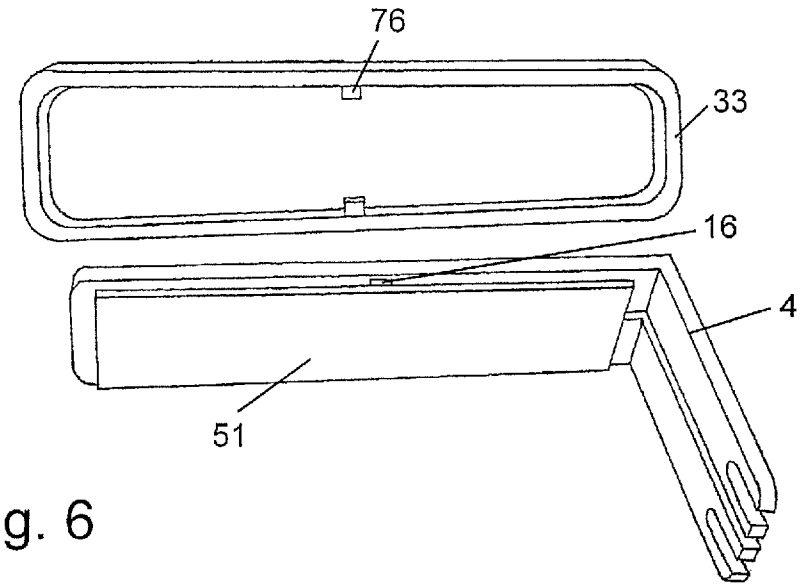
Figure 7:
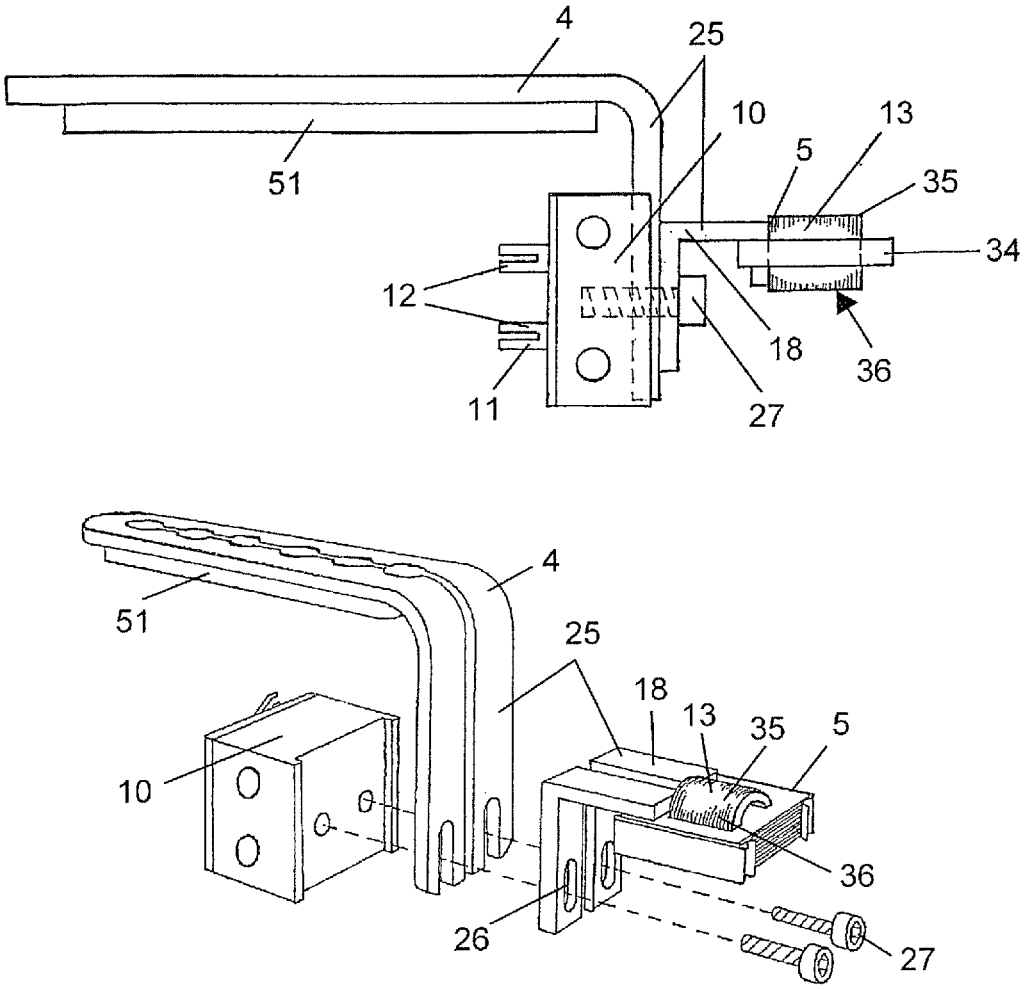
Figure 8:
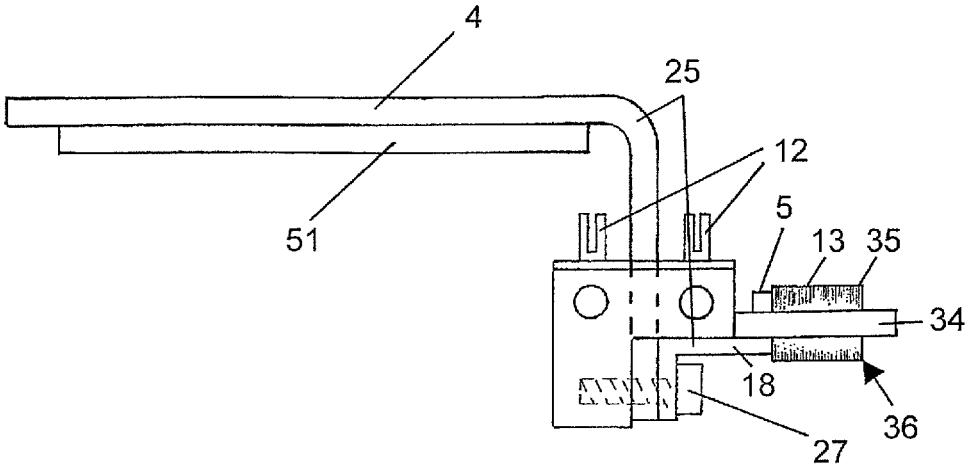
Figure 8:
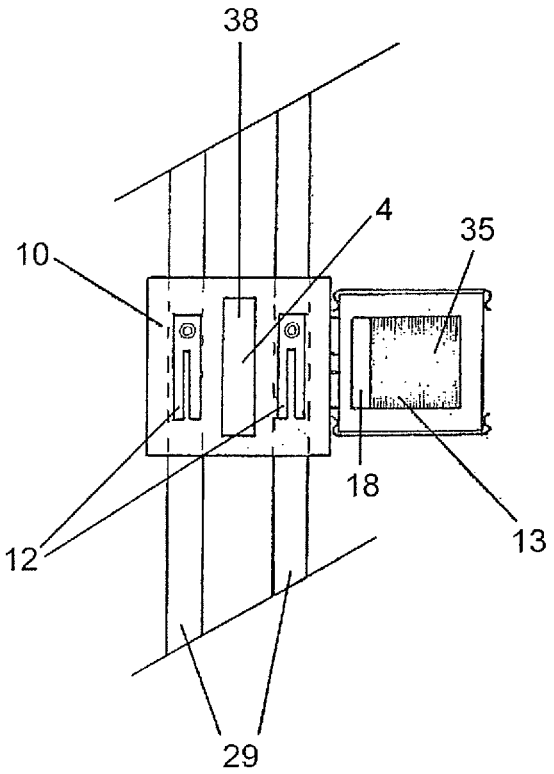
Figure 9:
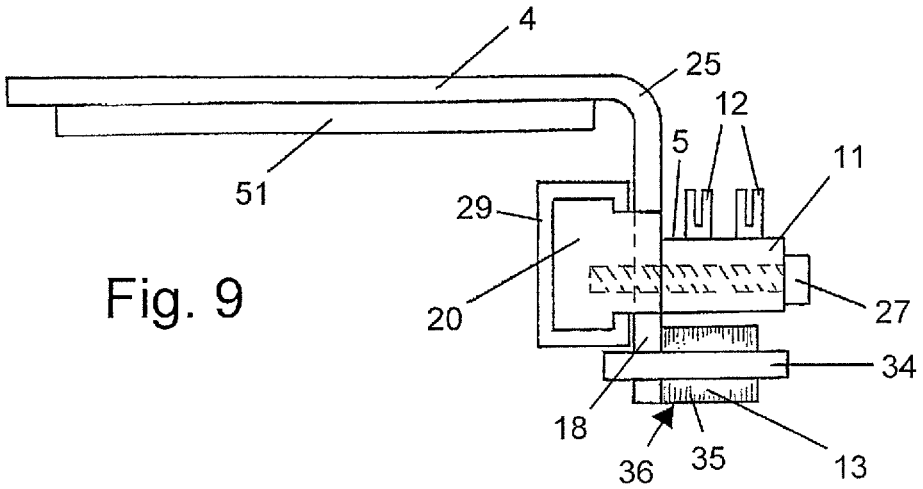
Figure 10:
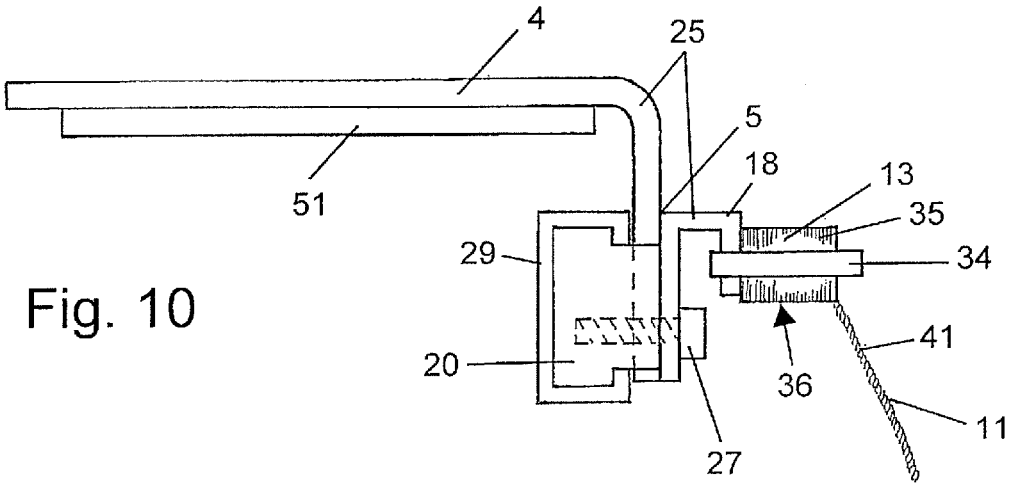

In the following the invention shall be illustrated on the basis of preferred embodiments with reference to the accompanying drawings. Wherein shows FIG. 1 an electrically-amplifiable stringed instrument with a pickup system according to the invention;

FIG. 2 a further perspective of the electrically-amplifiable stringed instrument according to FIG. 1;

FIG. 3 frontal view of a pickup system according to the invention;

FIG. 4 another perspective of a pickup system according to the invention;

FIG. 5 a further embodiment of a pickup system according to the invention;

FIG. 6 an L-shaped carrier element of a pickup system according to the invention;

FIG. 7 a further embodiment of a pickup system according to the invention;

FIG. 8 a further embodiment of a pickup system according to the invention;

FIG. 9 a further embodiment of a pickup system according to the invention; and FIG. 10 a further embodiment of a pickup system according to the invention.

In FIG. 1 an electrically-amplifiable stringed instrument 100, in particular an E-guitar or an E-bass guitar, is depicted. The electrically-amplifiable stringed instrument 100 comprises a body 1 and a neck 2. A head plate 19 is arranged at the side of the neck 2 facing away from the body 1. Strings 3, which are supported on a bridge 28 and fixated on a string holder 23, run from the head plate 19 via the neck 2 and the body 1. Tuning machines 24 for tuning the strings 3 are provided at the head plate 19. The body 1 comprises a base body 9 as well as a cover 7 in form of a pickguard 8, which is screw-mounted on the base body 9. A slit-shaped opening 6, in which an L-shaped carrier element 4 is movably arranged, is formed between the base body 9 and the pickguard 8. The L-shaped carrier element 4 is part of a pickup system 50. At least one pickup magnet 51 of an electromagnetic pickup 5, preferably a separate pickup magnet 51 for each string 3, is arranged at the L-shaped carrier element 4. A volume control knob 21 and a sound control knob 22 are arranged at the pickguard 8.

In FIG. 2 the electrically-amplifiable stringed instrument 100 according to the invention is depicted in the perspective from the string holder 23 in the direction of the neck 2. The strings 3 are supported in grooves on the bridge 28, whereby they are secured against lateral displacement. The L-shaped carrier element 4 is arranged between the base body 9 of the body 1 and the strings 3, so that the oscillations of the strings 3 can be converted into an electrical signal by the pickup magnet 51 of the electromagnetic pickup 5 which is arranged at the L-shaped carrier element 4. The slit-shaped opening 6 is parallel to the strings 3, i.e. parallel to an extension of the neck 2 in the direction of the body 1, so that the carrier element 4 and the pickup 5 are movable parallel to the strings 3. According to an alternative embodiment a variant is imaginable, in which the body 1 is realized in one piece and does not comprise a pickguard 8. In this one-piece embodiment the base body 9 comprises the slit-shaped opening 6 at its front surface, wherein a recess is provided at the rear surface of the body 1 for the glide body 10 and the other components of the pickup system 50 according to the invention.

In FIG. 3 a pickup system 50 according to the invention for an electrically-amplifiable stringed instrument 100 is depicted. The pickup system 50 comprises a first L-shaped carrier element 4 with a first pickup 5 and a second L-shaped carrier element 14 with a second pickup 15. The L-shaped carrier elements 4, 14 are each connected to a glide body 10, 20, which is movably guided along two gliding rails 29. A bracket 18 each is arranged at the glide body 10, 20 respectively at the L-shaped carrier elements 4, 14 which are connected with the glide body 10, 20, wherein the L-shaped carrier element 4, 14 and the bracket 18 each form a primary winding 25 of an amplification element 13 and a coil 35 which is arranged at the bracket 18 forms a secondary winding 36 of the amplification element 13. The L-shaped carrier element 4, 14 and/or the bracket 18 comprises/comprise a long hole 26, preferably two long holes 26, via which the L-shaped carrier element 5, 15 is connectable with the glide body 10, 20 by means of a screw joint. The height position and/or the inclination angle of the L-shaped carrier element 4, 14 and therefore of the pickup 5, 15 can be changed via the long hole 26. Alternative to the long hole 26, a cutout can be provided at the bracket 18 and/or at the L-shaped carrier element.

The glide bodies 10, 20 are connected with conductive paths 17 via transmission elements 11, preferably in form of sliding contacts 12, wherein two conductive paths 17, **17*a* each are provided per glide body 10, 20 respectively per pickup 5, 15, so that a signal of the pickup 5, 15 can be transmitted to the conductive paths 17, 17*a* via the sliding contacts 12. As shown in FIG. 4, openings are formed in the glide bodies 10, 20, via which the glide bodies 10, 20 are guided along the gliding rails 29. Via the run of the gliding rails 29 also the inclination angle lengthwise to the strings 3 is adjustable. Therefore, the inclination angle that is once chosen does not need to be adjusted anymore to achieve a pitch adjustment of the pickup 5, 15. It is moreover to realize that the gliding rails 29 run perpendicular to the L-shaped carrier elements 4, 14 and enable thereby a displacement parallel to the strings 3. With that the glide bodies 10, 20 for the first L-shaped carrier element 4 and the second L-shaped carrier element 14** are each movable independent of each other.

FIG. 5 shows a pickup system 50 according to the invention, which coincides to the greatest possible extent to the one shown in FIG. 3 and FIG. 4, but additionally comprises a support bracket 31 for fastening at a pickguard 8. For clarity, only a plate 32 is fixated to the support bracket 31 instead of a complete pickguard 8. Additionally, a support at the body 1 is possible via the long holes 36 and the screw 37, wherein the height and the inclination angle of the gliding rails 29 can be adjusted via the long holes 36.

According to an alternative embodiment also a variant is imaginable in which the body 1 is realized in one piece and does not comprise a pickguard 8. In this one-piece embodiment the base body 9 provides the slit-shaped opening 6 at its front surface, wherein a recess is provided at the rear surface of the body 1 for the glide body 10 and the other components of the pickup system 50 according to the invention.

In FIG. 6 the L-shaped carrier element 4 is depicted. The L-shaped carrier element 4 can include a recess 16, in which a cover cap 33 is retained. With that latching elements 76 can be provided at the L-shaped carrier element 4 and/or at the cover cap 33, which enable a latching of the cover cap 33 at the carrier element 4 and therefore ensure a stable connection. Alternatively the cover cap 33 can also be placed on the L-shaped carrier element 4, wherein no recess 16 is necessary, but a less stable connection between the cover cap 33 and the L-shaped carrier element 4 is implied.

In FIG. 7 a further embodiment of a pickup system 50 according to the invention is depicted. With a construction that is as far as possible equal to the pickup system 50 depicted in the previous figure, only differences are explained in the following. The L-shaped carrier element 4 is mounted at the glide body 10. At the glide body 10 moreover a bracket 18 is mounted, which forms together with the L-shaped carrier element 4, 14 the primary winding 25, which together with a coil 35 with a core 34, which form the secondary winding 36 forms the amplification element 13. Therefore the amplification of the signal of the pickup 5 is possible.

In FIG. 8 a further embodiment of a pickup system 50 according to the invention is depicted. With a construction that is as far as possible equal to the pickup system 50 depicted in the previous figure, only differences are explained in the following. The L-shaped carrier element 4 is retained in a slit 38 of the glide body 10. The transmission elements 11 are also realized as sliding contacts 12, but are located at the upper side of the glide body 10 in this embodiment. This is particularly advantageous in an embodiment of the electrically-amplifiable stringed instrument 100 with a pickguard 8, since in this case the conductive paths 17 can be arranged in the pickguard 8. By an appropriate design of the pickguard 8 the inclination angle of the conductive paths 17, 17*a* can be adjusted to the inclination angle of the gliding rails 29.

In FIG. 9 a further embodiment of a pickup system 50 according to the invention is depicted. With a construction that is as far as possible equal to the pickup system 50 depicted in the previous figure, only differences are explained in the following. In this embodiment the transmission element 11 is screwed with a screw 27 laterally on the glide body 10 respectively on the L-shaped carrier element 4. Thus the transmission element 11 can be exchanged particularly simple, for example at a wear of the sliding contacts 12. With that the brackets 18 and the L-shaped carrier element 4 can also be realized by one piece, if an opening for retaining the core 34 of the coil 35 is provided in the L-shaped carrier element 4, so that the coil 35 as secondary winding 36 is also easily detachable from the L-shaped transfer element 4 and is thereby easily exchangeable.

In FIG. 10 a further embodiment of a pickup system 50 according to the invention is depicted. With a construction that is as far as possible equal to the pickup system 50 depicted in the previous figure, only differences are explained in the following. A bracket 18 for the amplification element 13 is arranged at the L-shaped carrier element 4 or at the glide body 10. The amplification element 13 is connected with a connection cable 41, which is embodied as a transmission element 11. With that attention is to be paid that the connection cable 41 is long enough in order to enable a displacement of the glide body 10 along the whole length of the gliding rails 29.

The different embodiments of the invention as mentioned in the application are advantageously combinable, as long as not explained differently in isolated cases.

The invention claimed is:

1. A pickup system for an electrically-amplifiable stringed instrument, comprising:

a carrier element for a pickup magnet of an electromagnetic pickup;

wherein the carrier element is L-shaped and connected to a bracket, wherein the bracket supports a coil of a secondary winding of the electromagnetic pickup, and wherein the carrier element and the bracket form a primary winding of the electromagnetic pickup; and a glide body, wherein a retainer for the carrier element is provided at the glide body; and wherein, when the pickup system is mounted to an electrically-amplifiable stringed instrument, the glide body is movable with respect to the electrically-amplifiable stringed instrument.

2. The pickup system according to claim 1, wherein the glide body comprises:

a transmission element via which a signal of the electromagnetic pickup is transmittable.

3. The pickup system according to claim 2, wherein the transmission element comprises sliding contacts.

4. The pickup system according to claim 2, wherein at least one amplification element for an amplification of the signal of the electromagnetic pickup is arranged at the glide body.

5. The pickup system according to claim 1, further comprising:

an additional carrier element for an additional pickup magnet of a corresponding additional electromagnetic pickup, wherein the additional carrier element is L-shaped and connected to a corresponding additional bracket, wherein the additional bracket supports a corresponding additional coil of a corresponding additional secondary winding of the additional electromagnetic pickup, and wherein the additional carrier element and the additional bracket form a corresponding additional primary winding of the additional electromagnetic pickup; and a corresponding additional glide body, wherein a corresponding additional retainer for the additional carrier element is provided at the additional glide body, and wherein the glide body and the additional glide body are independently movable.

6. The pickup system according to claim 2, wherein the signal of the electromagnetic pickup is transmitted via the glide body to two conductive paths.

7. The pickup system according to claim 5, wherein the additional glide body comprises:

a corresponding additional transmission element via which a corresponding additional signal of the additional electromagnetic pickup is transmittable, wherein the signal of the electromagnetic pickup is transmitted via the glide body to two conductive paths, wherein the additional signal of the additional electromagnetic pickup is transmitted via the additional glide body to a corresponding additional two conductive paths, and wherein the additional two conductive paths are separate from the two conductive paths.

8. The pickup system according to claim 1, wherein the carrier element comprises a recess.

9. An electrically-amplifiable stringed instrument, comprising:

a body;

a neck;

strings, wherein the strings are guided with a distance from each other and parallel to the neck; and a pickup system, wherein the pickup system comprises:

a carrier element for a pickup magnet of an electromagnetic pickup, wherein the carrier element is L-shaped and connected to a bracket, wherein the bracket supports a coil of a secondary winding of the electromagnetic pickup, and wherein the carrier element and the bracket form a primary winding of the electromagnetic pickup; and a glide body, wherein a retainer for the carrier element is provided at the glide body, wherein the glide body is movable parallel to the neck, and wherein a slit-shaped opening is formed at the body, in which the carrier element is movably arranged.

10. The electrically-amplifiable stringed instrument according to claim 9, wherein:

(a) the slit-shaped opening runs:

(i) alongside the neck; or (ii) alongside an extension of the neck, through the body; or (b) the body is segmented into multiple parts, and wherein the body comprises:

a base body; and a cover, and wherein the slit-shaped opening is formed between the base body and the cover.

11. The electrically-amplifiable stringed instrument according to claim 9, wherein the electrically-amplifiable stringed instrument is an electric guitar or an electric bass guitar.

12. The electrically-amplifiable stringed instrument according to claim 10, wherein the cover is a pickguard.

* * * * *